US010385491B2

(12) United States Patent
Nitschke et al.

(10) Patent No.: US 10,385,491 B2
(45) Date of Patent: Aug. 20, 2019

(54) APPARATUS FOR MAKING A SPUNBOND NONWOVEN

(71) Applicant: Reifenhaeuser GmbH & Co. KG Maschinenfabrik, Troisdorf (DE)

(72) Inventors: Michael Nitschke, Koenigswinter (DE); Martin Swiatek, Rheinbach (DE); Martin Neuenhofer, Roesrath (DE); Hans-Georg Geus, Niederkassel (DE); Detlef Frey, Niederkassel (DE)

(73) Assignee: REIFENHAEUSER GMBH & CO. KG. MASCHINENFABRIK, Troisdorf (DE)

( * ) Notice: Subject to any disclaimer, the term of this patent is extended or adjusted under 35 U.S.C. 154(b) by 295 days.

(21) Appl. No.: 15/415,088

(22) Filed: Jan. 25, 2017

(65) Prior Publication Data

US 2017/0211218 A1 Jul. 27, 2017

(30) Foreign Application Priority Data

Jan. 27, 2016 (EP) ..... 16152906

(51) Int. Cl.
*D04H 3/16* (2006.01)
*D01H 5/32* (2006.01)
(Continued)

(52) U.S. Cl.
CPC ..... *D04H 3/16* (2013.01); *D01D 5/0985* (2013.01); *D01D 5/32* (2013.01); *D04H 3/02* (2013.01)

(58) Field of Classification Search
CPC .. D04H 3/16; D04H 3/02; D04H 5/32; D01D 5/0985
(Continued)

(56) References Cited

U.S. PATENT DOCUMENTS 7,849,902 B2 * 12/2010 Kuhn ..... D04H 3/16 156/181
8,591,213 B2 * 11/2013 Fare' ..... D01D 5/0985 425/66
(Continued)

*Primary Examiner* — Nahida Sultana
*Assistant Examiner* — Debjani Roy
(74) *Attorney, Agent, or Firm* — Andrew Wilford

(57) ABSTRACT

An apparatus for making a spunbond nonwoven from monofilaments of thermoplastic synthetics has a spinneret for spinning and emitting the filaments in a travel direction, a cooler downstream of the spinneret for cooling the spun filaments, and a stretcher downstream of the cooler for stretching the filaments. An intermediate passage extending in the travel direction between the cooler and the stretcher has upstream and downstream converging passage sections. The upstream passage section in the travel direction of the filaments having a shorter length than the downstream passage section in the travel direction of the filaments. A ratio $B_E/B_A$ of an inlet width $B_E$ to an outlet width $B_A$ of the upstream passage section is 1.5 to 5.5. A ratio of an inlet width $b_E$, to an outlet width $b_A$, of the downstream passage section is 1 to 4.

14 Claims, 3 Drawing Sheets

(51) Int. Cl.

| | |
|---|---|
| ***D04H 5/02*** | (2012.01) |
| ***D01D 5/32*** | (2006.01) |
| ***D01D 5/098*** | (2006.01) |
| ***D04H 3/02*** | (2006.01) |

(58) Field of Classification Search
USPC ..... 425/66, 72.2
See application file for complete search history.

(56) References Cited

U.S. PATENT DOCUMENTS

| | | | | |
|---|---|---|---|---|
| 10,094,058 | B2 * | 10/2018 | Hofemeister | D04H 3/02 |
| 2009/0004313 | A1 * | 1/2009 | Geus | D01D 5/0985 425/66 |

* cited by examiner

APPARATUS FOR MAKING A SPUNBOND NONWOVEN

FIELD OF THE INVENTION

The present invention relates to an apparatus for making a spunbond nonwoven.

BACKGROUND OF THE INVENTION

A spunbond nonwoven is typically made from monofilaments of thermoplastic polymer. Because of their virtually endless length, these monofilaments differ from staple fibers that have for example much shorter lengths of 10 mm to 60 mm.

The nonwoven is made in a continuous process starting with spinning of the monofilaments by a spinneret. The still hot monofilaments, normally passing vertically downward, are then cooled in a cooler and then elongated in a stretcher downstream from the cooler. An intermediate passage connects the cooler to the stretcher downstream therefrom.

Various embodiments of an apparatus of this type are known in principle from practice. However, many of these known apparatuses have the disadvantage that the filaments often cannot be deposited satisfactorily to form the spunbond nonwoven. This results in irregularities in the form of defects in the spunbond nonwoven in deposition of the filament. The homogeneity of the spunbond nonwovens is more or less greatly impaired due to these defects. One cause of defects in the spunbond nonwoven are so-called drips, which result from tearing one or more filaments as well as the accumulations of melt thereby formed. These drips may result in formation of thick spots in the spunbond nonwoven. Such drips and/or defects in the spunbond nonwoven are usually larger than 2×2 mm. However, defects in the spunbond nonwoven also result from so-called "hard pieces" that come about as a result of a loss of tension in the spun filament. The filaments relax and recoil and thus form a cluster that sticks together because of the molten state of the filament. The resulting defects produced in the spunbond nonwoven in this way normally are less than 2×2 mm in size. However, they are usually tangible and/or visible. Such defects occur primarily at a throughput greater than 120 km/h/m and in particular at a throughput greater than 150 kg/h/m. Greater spinning-zone lengths also promote irregularities in the spunbond nonwovens.

There have already been attempts to reduce these problems by making the filament treatment more uniform. In particular there have been attempts to reduce the defects in spunbond nonwovens by means of more uniform cooling in the cooler. Especially at high throughputs however, these measures have been successful only to a limited extent. There is thus a need for improvement.

OBJECTS OF THE INVENTION

It is therefore an object of the present invention to provide an improved apparatus for making a spunbond nonwoven.

Another object is the provision of such an improved apparatus for making a spunbond nonwoven that overcomes the above-given disadvantages, in particular that makes a finished nonwoven product with high homogeneity and no defects, even at high throughputs and/or high filament speeds as well as vertically longer spinning zones.

SUMMARY OF THE INVENTION

An apparatus for making a spunbond nonwoven from monofilaments of thermoplastic synthetics. The apparatus has according to the invention a spinneret for spinning and emitting the filaments in a travel direction, a cooler downstream in the travel direction of the spinneret for cooling the spun filaments, a stretcher downstream in the travel direction of the cooler for stretching the filaments, structure forming an intermediate passage extending in the travel direction between the cooler and the stretcher. The intermediate passage having upstream and downstream converging passage sections provided one after the other in the travel direction of the filaments, the upstream passage section in the travel direction of the filaments having a shorter length than the downstream passage section in the travel direction of the filaments, a ratio $B_E/B_A$ of an inlet width $B_E$ to an outlet width $B_A$ of the upstream passage section is 1.5 to 5.5, preferably 1.5 to 4, and most preferably 1.8 to 3.5, and a ratio of an inlet width $b_E$ to an outlet width $b_A$ of the downstream passage section is 1 to 4, preferably 1 to 3.3, especially 1.2 to 3.3, and most especially preferably 1.4 to 3.

A ratio of the inlet width $B_E$ to the outlet width $B_A$ of the upper passage section ($B_E/B_A$) 1.8 to 3, preferably 2 to 2.9 and in particular 2.2 to 2.8 and the ratio of the inlet width $b_E$ to the outlet width $b_A$ of the downstream passage section ($b_E/b_A$) is according to recommendation 1.6 to 2.9 and preferably 1.8 to 2.8.

The inlet widths $B_E$ and $b_E$ are measured at the upper (upstream) ends of the passage sections in the machine direction (MD) of the apparatus, which here is perpendicular to the travel direction of the filaments. The outlet widths $B_A$ and $b_A$ of the passage sections are measured similarly at the lower (downstream) ends of the passage sections in the machine direction (MD). Within the scope of the invention, the term "machine direction" (MD) refers in particular to the direction of travel of the deposited spunbond nonwoven sheeting. The filaments deposited to form the spunbond nonwoven and/or the spunbond nonwoven sheeting are carried off by the deposition element and/or with the deposition mesh belt, and this travel direction corresponds to the machine direction (MD).

It is within the scope of the present invention that the intermediate passage connects the cooler and the stretcher and/or a downdraft passage of the stretcher directly to one another. It is also within the scope of the invention for the intermediate passage to be designed to narrow over its entire length and to taper in the travel direction of the filaments and/or in the direction of deposition of the filaments. According to a particularly preferred embodiment, the intermediate passage has only the two converging passage sections provided one after the other and/or one below the other. Converging passage sections means accordingly that the cross-sectional size of each passage section grows smaller in the travel direction of the filaments and/or toward the deposition of the filaments. As recommended, the two passage sections converging one after the other and/or provided next to one another are connected directly to one another.

As already explained above, the apparatus according to the invention relates in particular to a spunbonding apparatus for making a spunbond nonwoven. It is within the scope of the invention that the spunbonding apparatus has a spinneret, a cooler, an intermediate passage, a stretch passage connected thereto and/or a lower passage as well as a deposition apparatus for deposition of the filaments to form the spunbond nonwoven, as seen one after the other in the travel direction of the filaments.

It is within the scope of the invention that the intermediate passage according to the invention and the stretch passage and/or lower passage of the stretcher connected thereto merge substantially directly into one another. Basically the intermediate passage and the stretch passage and/or the lower passage may then have the same angle of convergence, in particular in the transitional region.

According to a particularly preferred embodiment of the invention, a monomer vacuum device is provided in the area of the spinneret, preferably between the spinneret and the cooler. Furthermore according to a recommended embodiment of the apparatus according to the invention, at least one diffuser is provided between the stretch passage and/or the lower passage and the deposition. The deposition element is advantageously designed as a deposition mesh bolt and/or as a continuous deposition mesh bolt.

A most especially recommended embodiment of the apparatus according to the invention is characterized in that the assembly of the cooler, the intermediate passage and the lower passage connected thereto is designed as a closed system and, except for the supply of cooling air to the cooler, there is no additional air supply into this closed system. A particular embodiment of the invention is also characterized in that at least two diffusers, preferably only two diffusers are provided one after the other in the travel direction of the filament between the lower passage and the deposition site. At least one secondary air inlet gap for the admission of ambient air is advantageously provided between the two diffusers. This embodiment with two diffusers and a secondary air inlet gap between them also makes an advantageous contribution toward attaining the object of the invention.

According to one embodiment, the lower converging passage section of the intermediate passage and the stretch passage and/or lower stretch passage of the stretcher connected thereto has/have the same convergence. Then this lower converging passage section of the intermediate passage and the lower stretch passage connected directly thereto can merge one into the other more or less continuously. It is within the scope of the invention that for this case of the same angle of convergence of the two sections, the lengths defined above and below for the lower passage section of the intermediate passage relate to the total length of the lower converging passage section of the intermediate passage and the lower stretch passage. The same is preferably also true of the parameters calculated with the corresponding lengths and/or the calculated products and ratios.

A successful solution to the technical problem on which the invention is based has proven to be in particular an intermediate passage in which the ratio of the length L of the upstream passage section to the length l of the downstream passage section (L/l) is 1:3 to 1:20, advantageously 1:6 to 1:12, preferably 1:6 to 1:10 and preferably 1:7 to 1:9. It is thus within the scope of the present invention that the downstream passage section is designed to be much longer than the upstream passage section of the intermediate passage.

A recommended embodiment of the apparatus according to the invention is characterized in that the aperture angle $\alpha$ between an upper passage wall of the upstream and/or upper passage section and a center plane M running through the intermediate passage is 25° to 60°, preferably 30° to 55° and very preferably 35° to 50°. It is within the scope of the invention for the center plane M to be a vertical center plane M as well as to run transversely and preferably perpendicularly to the machine direction of the apparatus, as recommended, and in particular to run through the center of the intermediate passage. This (imaginary) center plane M is advantageously provided at a right angle to the surface of the deposition element and/or the deposition mesh belt.

A particularly recommended embodiment of the invention is characterized in that the aperture angle $\beta$ between the lower passage wall of the downstream and/or lower passage section and the center plane M running through the intermediate passage is 0.25° to 12°, preferably 0.3° to 8° and very preferably 0.4° to 6°. It is within the scope of the invention that the convergence per unit of length in the upper passage section of the intermediate passage is greater than that in the lower passage section.

According to a preferred embodiment of the invention, the aperture angle $\alpha$ between the two upper passage walls and the center plane M running through the intermediate passage is equally large or essentially of the same. According to one embodiment of the apparatus according to the invention, the aperture angle $\alpha$ between the upper passage wall and the center plane M is adjustable and is preferably adjustable steplessly. It is within the scope of the invention for the aperture angle $\beta$ between the two lower passage walls and the center plane M running through the intermediate passage to be the same and/or essentially the same. It is recommended that the aperture angle $\beta$ between the lower passage wall and the center plane be adjustable and preferably steplessly adjustable. According to recommendation, the convergence per unit of length in the upper passage section is greater than the convergence per unit of length in the lower passage section.

According to a proven embodiment of the invention, the ratio of the inlet width $B_E$ to the outlet width $B_A$ of the upstream passage section ($B_E/B_A$) is greater than the ratio of the inlet width $b_E$ to the outlet width $b_A$, of the downstream passage section ($b_E/b_A$) or both ratios $B_E/B_A$ and $b_E/b_A$ are the same and/or essentially the same. The product of the ratio $B_E/B_A$ and the length L of the upstream and/or upper passage section is advantageously 200 to 500, preferably 250 to 450, especially 300 to 400, most especially 320 to 390 and especially preferably 330 to 385. It is recommended that the product of the ratio $b_E/b_A$ and the length l of the downstream passage section should be between 1600 and 3250, preferably 1800 to 3250, especially 2000 to 2900, most especially 2100 to 2800 and especially preferably 2200 to 2750.

It is recommended that the ratio of the inlet width $B_E$ of the upstream passage section to the total length $L_G$ of the intermediate passage should be 0.15 to 0.30, preferably 0.18 to 0.30, especially 0.20 to 0.28 and most especially preferably 0.21 to 0.27. The ratio of the outlet width $B_A$ of the upstream passage section to the total length $L_G$ of the intermediate passage advantageously amounts to 0.05 to 0.15, preferably to 0.07 to 0.13 and most especially preferably to 0.08 to 0.12 and especially preferably to 0.09 to 0.11. The ratio of the inlet width $b_E$ of the downstream passage section to the total length $L_G$ of the intermediate passage is preferably 0.03 to 0.10, especially 0.04 to 0.08 and most especially preferably 0.05 to 0.06. A proven embodiment is characterized in that the ratio of the outlet width $b_A$ of the downstream passage section to the total length $L_G$ of the intermediate passage is 0.01 to 0.06, preferably 0.02 to 0.05 and especially preferably 0.02 to 0.04.

One embodiment that is especially important with regard to the solution to the technical problem on which the invention is based in combination with the embodiment of the intermediate passage according to the invention is characterized in that at least one monomer aspirator for sucking out the gases formed in the spinning process is provided downstream from or below the spinneret. With this monomer aspirator, air and/or gas is sucked out of the filament-forming space of the spinneret and/or directly below the spinneret. This removes the gases in the form of monomers, oligomers, decomposition products and the like emerging next to the polymer filaments from the filament-forming space and/or from the filament-forming device.

A particularly recommended embodiment of the apparatus according to the invention is characterized in that the monomer aspirator has at least two vacuum ports, advantageously CD suction gaps provided one after the other, preferably in the machine direction (MD), each extending transversely, preferably perpendicular to the machine direction and opposite one another with respect to where the filaments are spun. It is within the scope of the invention for the CD suction ports to be subdivided into CD vacuum subports and/or for the CD suction gaps to be subdivided into CD suction subports. The CD suction subports may also be designed in the form of suction holes provided side by side.

The two CD vacuum ports and/or CD suction gaps are set up such that according to the recommendation a higher volume flow of gas can be sucked out through one of the two CD vacuum ports and/or CD vacuum gaps than through the other opposing CD vacuum port and/or CD vacuum gap. The suction removal of the higher volume flow as a gas can be effected by using a different size and/or width of the CD vacuum ports and/or CD vacuum gaps and/or by setting the volume flow on the vacuum lines and/or vacuum units connected to the CD vacuum ports and/or CD vacuum gaps. The setting of the vacuum lines and/or vacuum units may be accomplished in particular with the help of throttle elements and/or flow-control elements.

According to one embodiment of the invention, a higher volume flow of gas can be vacuumed continuously through one of the two CD vacuum ports and/or CD vacuum gaps than through the other opposing CD vacuum port and/or CD vacuum gap. However, it is also within the scope of the invention to operate in cycles, so that a greater volume flow of gas can be sucked out upstream through the one CD vacuum port and then through the other CD vacuum port, etc.

According to one embodiment, the port of a CD section port is larger, i.e. it can be set larger than the port of the second CD vacuum port on the opposite side with respect to the spinning zone. Basically however the two ports may also be of the same size and the volume flows sucked out in different amounts on the two sides are set as described above. It is also within the scope of the invention that the ports of the CD vacuum gaps and/or CD vacuum gap sections are adjustable.

The invention is based on the discovery that the embodiment of the monomer aspirator described above is particularly advantageous in combination with the embodiment of the intermediate passage according to the invention with respect to attaining the object on which the invention is based.

It is also within the scope of the invention that the intermediate passage according to the invention is connected to the cooler and/or directly to the cooler. According to a very preferred embodiment of the invention, the cooler is subdivided into at least two compartments provided one above the other and/or one after the other in the travel direction of the filament, and air and/or cooling air at different temperatures can enter the filament flow space from the two passage sections. This embodiment has also proven very successful in combination with the intermediate passage according to the invention.

The spinning-zone length advantageously amounts to 120 to 400 mm, preferably 150 to 350 mm, very preferably 170 to 300 mm and especially preferably 185 to 270 mm. The spinning-zone length refers in particular to the extent of the spun filament bundle in the machine direction (MD). According to a particularly recommended embodiment of the invention, the spinning-zone length amounts to 195 to 260 mm. At the above-described spinning-zone lengths, the object according to the invention can be attained effectively and without any problems.

To attain the inventive object, the invention also discloses a method of making a spunbond nonwoven from monofilament, in particular from monofilament made of a thermoplastic polymer, where the filaments are spun by a spinneret, the spun filaments are cooled in a cooler and then passed through an intermediate passage and then next through a lower passage and the filaments are deposited on a deposition element to form the spunbond nonwoven, wherein the intermediate passage has at least two passage sections provided one after the other and/or beside one another so that they converge, wherein the extent of the convergence of the two passage sections is different, wherein the length of the two converging passage sections is different, wherein the ratio of the inlet width $B_E$ to the outlet width $B_A$ of the upstream passage section ($B_E/B_A$) is greater than the ratio of the inlet width $b_E$ to the outlet width $b_A$ of the downstream passage section ($b_E/b_A$) and the ratio of the inlet width $b_E$ to the outlet width $b_A$ of the downstream passage section ($b_E/b_A$) is 1 to 4, preferably 1 to 3.3, especially 1.2 to 3.3, most especially 1.4 to 3, and wherein the filaments are made at a throughput of 100 to 350 kg/h/m, preferably at a throughput of 150 to 320 kg/h/m, especially at a throughput of 180 to 300 kg/h/m and most especially preferably at a throughput of 200 to 300 kg/h/m. The filaments are advantageously made at a thread speed of 2000 to 4200 m/min, preferably at 2200 to 4000 m/min, and in particular at 2300 to 3900 m/min.

The invention is based first on the discovery that a very stable transport of filaments through the apparatus is possible with the apparatus according to the invention and in particular with the intermediate passage according to the invention. Effective acceleration of the process air and/or cooling air can be achieved in the intermediate passage, namely as a prerequisite for efficient downstream transfer of force between the process air and the filaments.

The invention is also based on the discovery that spunbond nonwovens, which are characterized by an optimal homogeneity and in which flaws and/or defects are hardly observed or are almost not observed at all, can be made with the apparatus according to the invention with no problem. In the production of spunbond nonwovens using the apparatus according to the invention, the above-mentioned drips and hard pieces mentioned as a disadvantage can be largely prevented and/or minimized. It should be emphasized that a more or less defect-free deposition of nonwoven can also be achieved even with longer spinning zones and with high throughputs as well as with high thread speeds. In this context it should be emphasized that the implementation of the intermediate passage according to the invention is possible with relatively simple means and/or measures. Therefore the apparatus according to the invention is also characterized by being inexpensive. Within the scope of the invention and/or for the solution to the technical problem, the combination of the intermediate passage according to the invention, on the one hand, and the monomer aspirator that has already been described, on the other hand, deserves special attention. Within the scope of this combination, especially homogeneous spunbond nonwovens having virtually no defects can be made with this apparatus. As a result, spunbond nonwovens with an excellent quality and/or homogeneity can be made with the apparatus according to the invention and nevertheless the apparatus according to the invention has a simple and inexpensive design.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
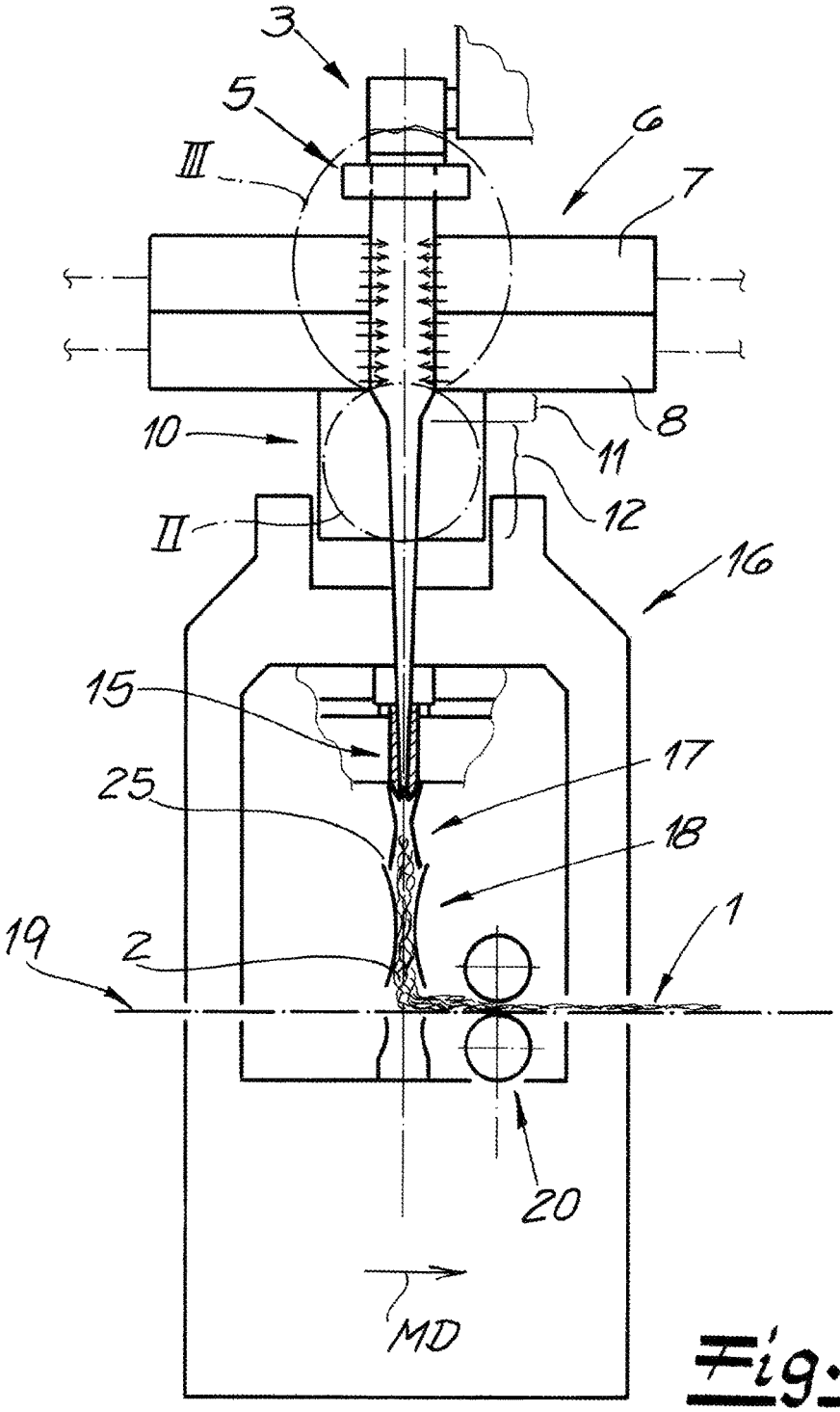
FIG. 1 is a schematic vertical section through an apparatus according to the invention.
Figure 2:
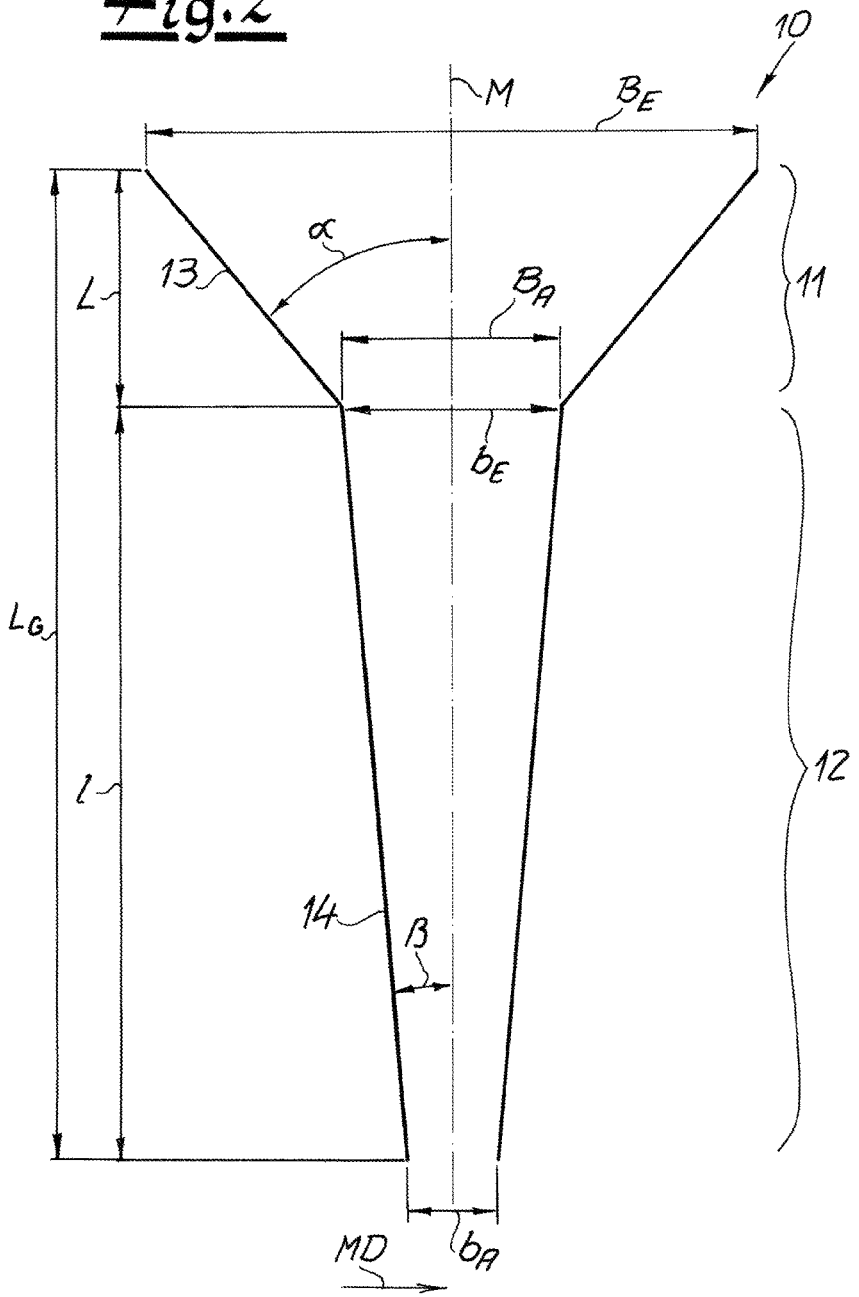
FIG. 2 is a large-scale view of the detail shown at II in FIG. 1 of the intermediate passage according to the invention.
Figure 3:
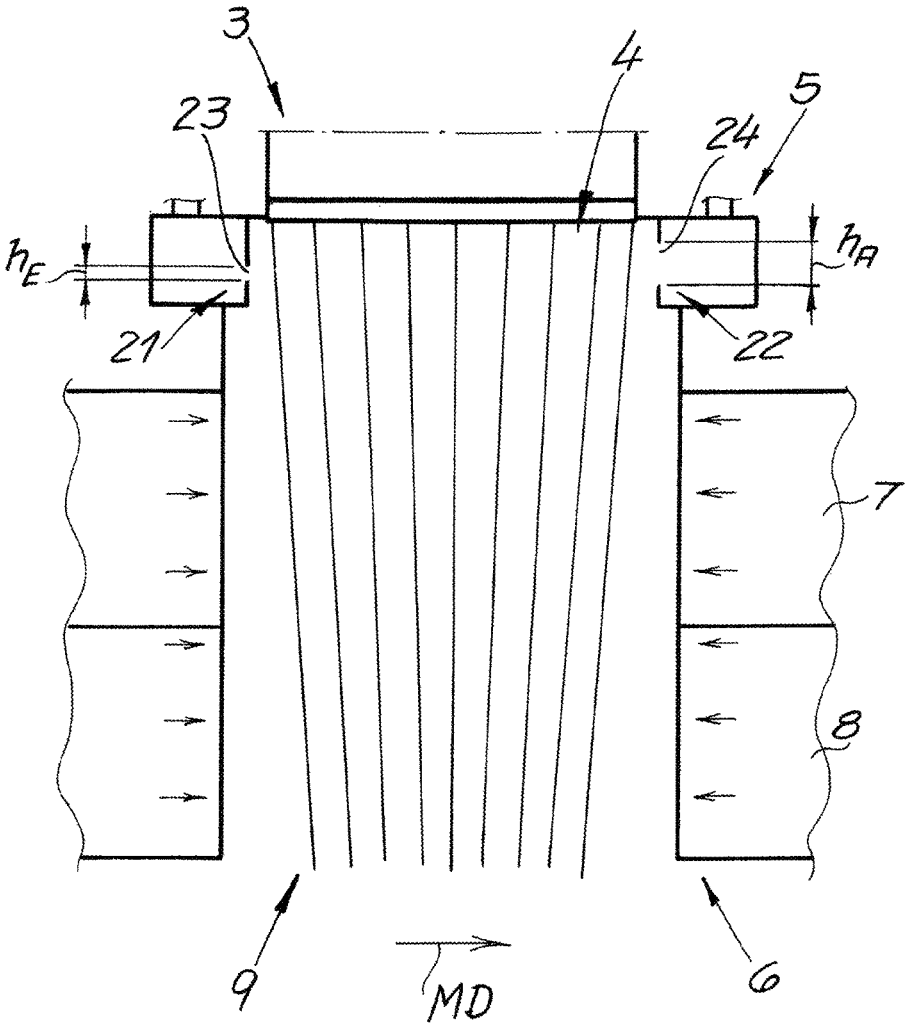
FIG. 3 is a large-scale view of the detail shown at III in FIG. 1.

As seen in FIG. 1, an apparatus according to the invention for making a spunbond nonwoven 1 from monofilaments 2 creates monofilaments 2 made entirely or essentially of thermoplastic synthetic resin. In this illustrated embodiment, the monofilaments 2 are spun using a spinneret 3 and, in a filament-forming zone 4 below the spinneret 3, they are passed through a monomer aspirator 5 for vacuum removal of gases formed during the spinning process. A cooler 6 downstream from and/or below this monomer aspirator 5 as seen in the travel direction of the filament cools the monofilaments 2. Advantageously and in the illustrated embodiment, this cooler 3 has an air-supply chamber, preferably subdivided into two compartments 7, 8 in the illustrated embodiment. Cooling air at an adjustable temperature can be supplied in the direction of the filament bundle 9 advantageously and in the illustrated embodiment.

The intermediate passage 10 according to the invention is connected to the cooler 6 downstream in the travel direction of the filaments. The intermediate passage 10 according to the invention is subdivided into two converging passage sections 11, 12 provided one below the other or after the other and converging in the travel direction of the filaments. The upstream and/or upper passage section 11 in the travel direction of the filaments has a shorter length (in the travel direction of the filaments) than the downstream and/or lower passage section 12 in the travel direction of the filaments. Preferably and in the illustrated embodiment, the ratio of the inlet width $B_E$ to the outlet width $B_A$ of the upstream passage section 11 is 2.25 to 2.75. The ratio of the inlet width $b_E$ to the outlet width $b_A$ of the downstream passage section 12 according to the recommendation and in the illustrated embodiment has a value of 1.9 to 2.7. The ratio of the length L of the upstream passage section 11 to the length l of the downstream passage section 12 is advantageously and in the illustrated embodiment 1:7 to 1:9.

The aperture angle $\alpha$ between the upper passage wall 13 of the upstream and/or upper passage section 11 and the center plane M running through the intermediate passage 10 very preferably and in the illustrated embodiment amounts to 30° to 50°. A center plane M extends transversely, preferably perpendicularly to the machine direction (MD) of the apparatus in this illustrated embodiment. Advantageously and in the illustrated embodiment, the aperture angle $\beta$ between the lower passage wall 14 of the downstream and/or lower passage section 12 and the center plane M running through the intermediate passage 10 amounts to M 0.4° to 6°.

According to the recommendation and in the illustrated embodiment, a lower passage 15 of the stretcher 16 is connected to the intermediate passage 10 according to the invention. Preferably and in the illustrated embodiment, the assembly of the cooler 6, the intermediate passage 10 and the stretcher 16 and/or the lower passage 15 is designed as a closed system and in addition to the supply of cooling air in the cooler 6, there is no other air supply in this closed system.

Advantageously and in the illustrated embodiment, two diffusers 17, 18 through which the monofilaments 2 are passed are provided downstream from and/or below the stretcher 16 in the travel direction of the filaments. According to a particularly preferred embodiment and in the illustrated embodiment, a secondary air inlet gap and/or an ambient air inlet gap 25 for the admission of ambient air is/are provided between the two diffusers 17 and 18. Preferably and in the illustrated embodiment, the monofilaments 2 are deposited on a support surface designed as a mesh belt 19 to form the spunbond nonwoven web downstream from the diffusers 17, 18. It is within the scope of the invention for the spunbond nonwoven to then be passed through a calendar 20 for stabilization and/or pre-stabilization.

According to a preferred embodiment and in the illustrated embodiment, the monomer aspirator 5 has two opposing CD vacuum ports 21, 22 provided one after the other in the machine direction (MD), each extending transversely to the machine direction and opposite one another with respect to the spinning zone. These CD vacuum ports are preferably designed as CD vacuum gaps 23, 24 in the illustrated embodiment. Here a higher volume flow is removed by suction through the rear CD vacuum gap 24, as seen in the machine direction, than through the front CD vacuum gap 23 in the machine direction. Preferably and in the illustrated embodiment, the vertical gap height $h_A$ of the rear CD vacuum gap 24 in the machine direction is greater than the vertical gap height $h_E$ of the front CD vacuum gap 23 in the machine direction. According to one embodiment of the invention and in the illustrated embodiment, the gap height $h_A$ of the rear CD vacuum gap 24 in the machine direction is more than twice the gap height $h_E$ of the CD vacuum gap 23 which is at the front in the machine direction.

We claim:

1. An apparatus for making a spunbond nonwoven from monofilaments of thermoplastic synthetics, the apparatus comprising:

a spinneret for spinning and emitting the filaments in a travel direction;

a cooler downstream in the travel direction of the spinneret for cooling the spun filaments;

a stretcher downstream in the travel direction of the cooler for stretching the filaments;

structure forming an intermediate passage extending in the travel direction between the cooler and the stretcher, the intermediate passage having upstream and downstream converging passage sections provided one after the other in the travel direction of the filaments, the upstream passage section in the travel direction of the filaments having a shorter length than the downstream passage section in the travel direction of the filaments, a ratio $B_E/B_A$ of an inlet width $B_E$ to an outlet width $B_A$ of the upstream passage section being 1.5 to 5.5, a ratio of an inlet width $b_E$ to an outlet width $b_A$ of the downstream passage section being 1 to 4, an opening angle between an upper passage wall of the upstream passage section and a center plane extending in the travel direction through the intermediate passage being 25° to 60°.

2. The apparatus defined in claim 1, wherein the intermediate passage connects the cooler and the stretcher directly to one another.

3. The apparatus defined in claim 1, wherein the cooler, the intermediate passage and the stretcher form a closed system and there is no additional supply of air into this closed system other than cooling air from the cooler.

4. The apparatus defined in claim 1, wherein a ratio of a length in the travel direction of the upstream passage section to a length in the travel direction of the downstream passage section is 1:3 to 1:20.

5. An apparatus for making a spunbond nonwoven from monofilaments of thermoplastic synthetics, the apparatus comprising:

a spinneret for spinning and emitting the filaments in a travel direction;

a cooler downstream in the travel direction of the spinneret for cooling the spun filaments;

a stretcher downstream in the travel direction of the cooler for stretching the filaments;

structure forming an intermediate passage extending in the travel direction between the cooler and the stretcher, the intermediate passage having upstream and downstream converging passage sections provided one after the other in the travel direction of the filaments, the upstream passage section in the travel direction of the filaments having a shorter length than the downstream passage section in the travel direction of the filaments, a ratio $B_E/B_A$ of an inlet width $B_E$ to an outlet width $B_A$ of the upstream passage section being 1.5 to 5.5, a ratio of an inlet width $b_E$ to an outlet width $b_A$ of the downstream passage section being 1 to 4, an opening angle between an upper passage wall of the downstream passage section and the center plane being 0.25° to 12°.

6. An apparatus for making a spunbond nonwoven from monofilaments of thermoplastic synthetics, the apparatus comprising:

a spinneret for spinning and emitting the filaments in a travel direction;

a cooler downstream in the travel direction of the spinneret for cooling the spun filaments;

a stretcher downstream in the travel direction of the cooler for stretching the filaments;

structure forming an intermediate passage extending in the travel direction between the cooler and the stretcher, the intermediate passage having upstream and downstream converging passage sections provided one after the other in the travel direction of the filaments, the upstream passage section in the travel direction of the filaments having a shorter length than the downstream passage section in the travel direction of the filaments, a ratio $B_E/B_A$ of an inlet width $B_E$ to an outlet width $B_A$ of the upstream passage section being 1.5 to 5.5, a ratio of an inlet width $b_E$ to an outlet width $b_A$ of the downstream passage section being 1 to 4, the ratio $B_E/B_A$ being larger than or equal to the ratio $b_E/b_A$.

7. An apparatus for making a spunbond nonwoven from monofilaments of thermoplastic synthetics, the apparatus comprising:

a spinneret for spinning and emitting the filaments in a travel direction;

a cooler downstream in the travel direction of the spinneret for cooling the spun filaments;

a stretcher downstream in the travel direction of the cooler for stretching the filaments;

structure forming an intermediate passage extending in the travel direction between the cooler and the stretcher, the intermediate passage having upstream and downstream converging passage sections provided one after the other in the travel direction of the filaments, the upstream passage section in the travel direction of the filaments having a shorter length than the downstream passage section in the travel direction of the filaments, a ratio $B_E/B_A$ of an inlet width $B_E$ to an outlet width $B_A$ of the upstream passage section being 1.5 to 5.5, a ratio of an inlet width $b_E$ to an outlet width $b_A$ of the downstream passage section being 1 to 4, and a product of the ratio $B_E/B_A$ and a length in the travel direction of the upstream section being 200 to 500.

8. An apparatus for making a spunbond nonwoven from monofilaments of thermoplastic synthetics, the apparatus comprising:

a spinneret for spinning and emitting the filaments in a travel direction;

a cooler downstream in the travel direction of the spinneret for cooling the spun filaments;

a stretcher downstream in the travel direction of the cooler for stretching the filaments;

structure forming an intermediate passage extending in the travel direction between the cooler and the stretcher, the intermediate passage having upstream and downstream converging passage sections provided one after the other in the travel direction of the filaments, the upstream passage section in the travel direction of the filaments having a shorter length than the downstream passage section in the travel direction of the filaments, a ratio $B_E/B_A$ of an inlet width $B_E$ to an outlet width $B_A$ of the upstream passage section being 1.5 to 5.5, a ratio of an inlet width $b_E$ to an outlet width $b_A$ of the downstream passage section being 1 to 4, a product of the ratio $b_E/b_A$ and a length in the travel direction of the downstream passage section being 1600 to 3250.

9. The apparatus defined in claim 1, wherein a ratio of the inlet width $B_E$ of the upstream passage section to a total length in the travel direction of the intermediate passage is 0.15 to 0.30.

10. The apparatus defined in claim 1, further comprising:

a monomer aspirator immediately downstream of the spinneret for suction removal of gases generated by spinning of the monofilaments.

11. The apparatus defined in claim 10, wherein the monomer aspirator is set up such that different volume flows of gas can be removed by suction on opposing sides spaced apart transversely of the travel direction and flanking the filaments from the spinneret.

12. The apparatus defined in claim 1, wherein the cooler has upper and lower compartments one after the other in the travel direction, with cooling air at a different temperatures and convective thermal heat dissipation capacities.

13. The apparatus defined in claim 1, further comprising:

a diffuser through which the filaments pass in the travel direction immediately downstream of the stretcher; and a deposition element downstream of the diffuser and receiving the filaments therefrom.

14. A method of making a spunbond nonwoven using an apparatus comprising:

a spinneret for spinning and emitting the filaments in a travel direction;

a cooler downstream in the travel direction of the spinneret for cooling the spun filaments;

a stretcher downstream in the travel direction of the cooler for stretching the filaments;

structure forming an intermediate passage extending in the travel direction between the cooler and the stretcher, the intermediate passage having upstream and downstream converging passage sections provided one after the other in the travel direction of the filaments, the upstream passage section in the travel direction of the filaments having a shorter length than the downstream passage section in the travel direction of the filaments, a ratio $B_E/B_A$ of an inlet width $B_E$ to an outlet width $B_A$ of the upstream passage section being 1.5 to 5.5, a ratio of an inlet width $b_E$ to an outlet width $b_A$ of the downstream passage section being 1 to 4, an opening angle between an upper passage wall of the upstream passage section and a center plane extending in the travel direction through the intermediate passage being 25° to 60° the method including the step of:

moving the filaments through the apparatus at a throughput rate of 100 to 350 kg/h/m.

* * * * *